US011557844B2

(12) United States Patent
Kawai

(10) Patent No.: US 11,557,844 B2
(45) Date of Patent: Jan. 17, 2023

(54) TERMINAL, ELECTRIC WIRE WITH TERMINAL USING THE TERMINAL, AND ELECTRIC CONNECTION MEMBER

(71) Applicant: Yazaki Corporation, Tokyo (JP)

(72) Inventor: Hiroki Kawai, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/038,263

(22) Filed: Sep. 30, 2020

(65) Prior Publication Data

US 2021/0104825 A1 Apr. 8, 2021

(30) Foreign Application Priority Data

Oct. 2, 2019 (JP) ..... JP2019-182024

(51) Int. Cl.

| | |
|---|---|
| ***H01R 4/20*** | (2006.01) |
| ***H01R 4/58*** | (2006.01) |
| ***H01B 1/04*** | (2006.01) |
| ***H01B 7/28*** | (2006.01) |

(52) U.S. Cl.

CPC ..... *H01R 4/58* (2013.01); *H01B 1/04* (2013.01); *H01B 7/2806* (2013.01)

(58) Field of Classification Search

CPC ..... H01R 4/20

See application file for complete search history.

(56) References Cited

U.S. PATENT DOCUMENTS

| | | | | |
|---|---|---|---|---|
| 4,734,041 | A * | 3/1988 | Bruchmann | H01R 12/82 439/924.1 |
| 9,004,953 | B2 * | 4/2015 | Finona | H01R 13/6473 439/668 |
| 9,065,189 | B2 * | 6/2015 | Ohnuma | H01R 4/183 |
| 9,735,490 | B2 * | 8/2017 | Wu | H01R 13/113 |
| 9,780,460 | B2 * | 10/2017 | Koto | H01R 4/72 |
| 10,008,836 | B2 * | 6/2018 | Nakayama | H01M 50/20 |
| 2007/0149050 | A1 * | 6/2007 | Oka | H01R 13/03 439/595 |
| 2012/0175166 | A1 * | 7/2012 | Ooishi | H01R 4/62 174/72 A |

(Continued)

FOREIGN PATENT DOCUMENTS

| | | |
|---|---|---|
| JP | 2014-164966 | 9/2014 |
| JP | 2015-79647 A | 4/2015 |

(Continued)

*Primary Examiner* — Chau N Nguyen

(74) *Attorney, Agent, or Firm* — Sughrue Mion, PLLC

(57) ABSTRACT

A terminal includes a conductor connecting part, a terminal connecting part, and a graphene film. When a first metal material and a third metal material forming a conductor of an electric wire have different ionization tendencies, the graphene film is provided to be arranged between a first surface and the conductor of the electric wire when the conductor of the electric wire is electrically connected to the conductor connecting part. When a second metal material and a fourth metal material forming a surface of an opposite terminal have different ionization tendencies, the graphene film is provided to be arranged between a second surface and the surface of the opposite terminal when the opposite terminal is electrically connected to the terminal connecting part.

6 Claims, 9 Drawing Sheets

(56) References Cited

U.S. PATENT DOCUMENTS

| | | | | |
|---|---|---|---|---|
| 2015/0359065 | A1* | 12/2015 | Park | H05B 33/26 313/511 |
| 2016/0264533 | A1 | 9/2016 | Nomura et al. | |
| 2016/0344125 | A1 | 11/2016 | Thorner | |
| 2020/0395690 | A1 | 12/2020 | Wang | |
| 2021/0135379 | A1* | 5/2021 | Mochizuki | H01R 43/048 |

FOREIGN PATENT DOCUMENTS

| | | | |
|---|---|---|---|
| JP | 2015-518235 | A | 6/2015 |
| JP | 2019-036499 | A | 3/2019 |
| WO | 2013/142050 | A1 | 9/2013 |
| WO | 2018223954 | A1 | 12/2018 |

* cited by examiner

TERMINAL, ELECTRIC WIRE WITH TERMINAL USING THE TERMINAL, AND ELECTRIC CONNECTION MEMBER

CROSS-REFERANCE TO RELATED APPLICATIONS

The present application is based on, and claims priority from Japanese Patent Application No. 2019-182024, filed on Oct. 2, 2019, the entire contents of which are incorporated herein by reference.

TECHNICAL FIELD

The present disclosure relates to a terminal, an electric wire with terminal using the terminal, and an electric connection member.

BACKGROUND

For weight reduction in vehicles, it is considered to use aluminum electric wires as wiring in vehicles instead of conventional copper electric wires. An electric wire with terminal in which an aluminum electric wire and a copper connector terminal are caulked and connected, however the electric wire with terminal has a contact part of different metal members. When moisture adheres to the contact part of the different kind of metal members having different ionization tendencies, a metal member having a high ionization tendency is oxidized, and galvanic corrosion may occur. JP 2019-36499A discloses an electric wire with terminal having an exposed conductor of an electric wire covered with resin so that moisture does not adhere to the contact part of different kind of metal members.

The electric wire with terminal of JP 2019-36499A is provided with a pair of crimping pieces for crimping the exposed conductor part of the electric wire, and a pair of caulking pieces for caulking the cover of the electric wire. The electric wire with terminal has a resin injection port formed therein. Resin injected from the resin injection port infiltrates into a resin filling space from only one side of the resin filling space, preventing air from remaining at the bottom of the resin filling space. Since air is prevented from remaing in the resin filling space when the resin is injected into the resin filling space, the resin effectively infiltrates into the resin filling space. Thus, the electric wire with terminal effectively prevents the occurrence of galvanic corrosion.

SUMMARY

The electric wire with terminal described in JP 2019-36499A needs to cover the contact part of different kind of metals with a resin or the like not to supply the contact part with moisture causing galvanic corrosion. Accordingly, the manufacturing process of the electric wire with terminal becomes complicated, and the manufacturing cost tends to increase. Further, it is necessary to form the terminal into a special shape and to adhere the resin member closely to the metal member without any gap so that moisture does not adhere to the contact part of the different kind of metal members. Due to the restriction on the terminal shape, the degree of freedom in design decreases, and the miniaturization of the terminal tends to be difficult.

The present disclosure is made in view of the above problem. An object of the present disclosure is to provide a terminal that prevents galvanic corrosion at a contact part of different kind of metals, an electric wire with terminal using the terminal, and an electric connection member.

A terminal according to an aspect of the present disclosure includes a conductor connecting part provided to be electrically connected to a conductor of an electric wire, a terminal connecting part provided to be electrically connected to an opposite terminal, and a graphene film. A first surface that is at least a part of the conductor connecting part is formed of a first metal material, and a second surface that is at least a part of the terminal connecting part is formed of a second metal material. The graphene film is provided on at least one of an outer surface of the first surface and an outer surface of the second surface. When the first metal material and a third metal material forming the conductor of the electric wire have different ionization tendencies, the graphene film is provided to be arranged between the first surface and the conductor of the electric wire when the conductor of the electric wire is electrically connected to the conductor connecting part. When the second metal material and a fourth metal material forming the surface of the opposite terminal have different ionization tendencies, the graphene film is provided to be arranged between the second surface and the surface of the opposite terminal when the opposite terminal is electrically connected to the terminal connecting part.

The first metal material may be copper, and the third metal material may be aluminum.

An electric wire with terminal according to another aspect of the present disclosure includes the terminal and the electric wire connected to the terminal, and the conductor of the electric wire is electrically connected to the conductor connecting part.

The electric wire with terminal may not have a resin arranged across the terminal and the conductor of the electric wire for covering the terminal and the conductor.

An electric connection member according to another aspect of the present disclosure includes the terminal and the opposite terminal, and the terminal and the opposite terminal are connected to each other.

The present disclosure provides a terminal preventing galvanic corrosion at a contact part of different kind of metals, an electric wire with terminal using the terminal, and an electric connection member.

DETAILED DESCRIPTION

Figure 1:
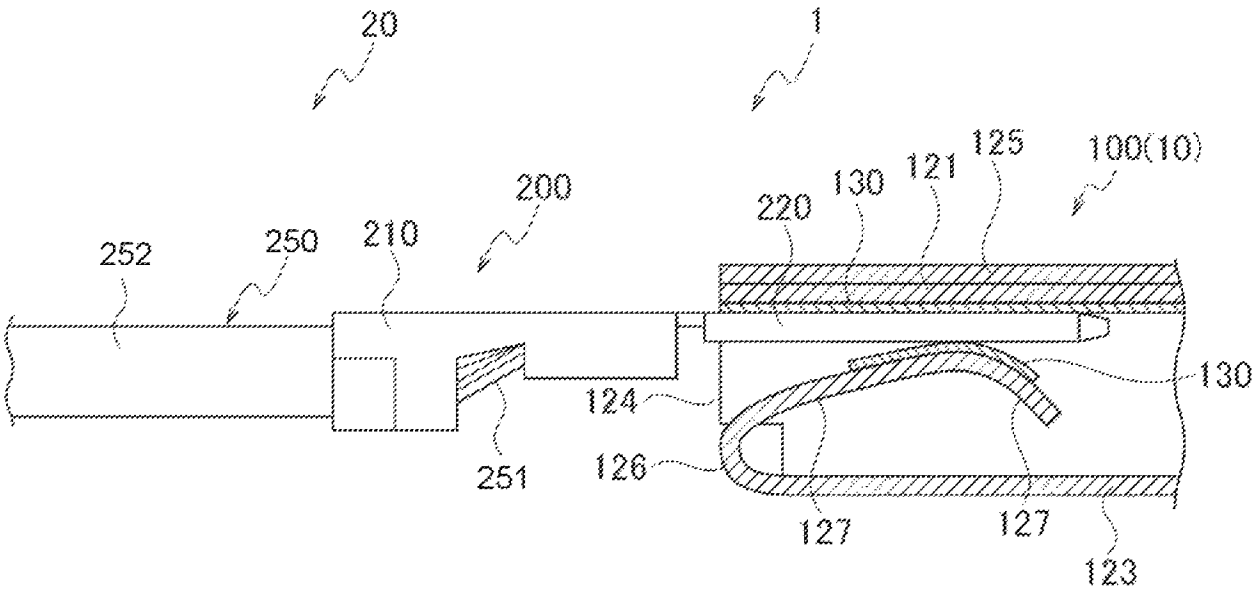
FIG. 1 is a sectional view of an example of an electric connection member in which a female terminal and a male terminal are connected to each other.

The following describes a terminal, an electric wire with terminal using the terminal, and an electric connection member according to the present embodiment in detail with reference to the drawings. Dimensional ratios in the drawings are exaggerated for explanation and may differ from the actual ratios.

[Terminal]

With reference to FIGS. 1 to 8, a female terminal 100 and a male terminal 200 are described as an example of a terminal according to the present embodiment. FIG. 1 is a sectional view of an example of an electric connection member 1 in which the female terminal 100 and the male terminal 200 are connected to each other. As shown in FIG. 1, when a terminal connecting part 220 of the male terminal 200 is inserted into a terminal connecting part 120 of the female terminal 100, the female terminal 100 and the male terminal 200 are engaged with each other. When the female terminal 100 is engaged with the male terminal 200, the terminal connecting part 120 of the female terminal 100 and the terminal connecting part 220 of the male terminal 200 are physically and electrically connected to each other. As described later, at least a part of the surface of the terminal connecting part 120 and at least a part of the surface of the terminal connecting part 220 are electrically conductive, so that an electric wire 150 connected to the female terminal 100 and an electric wire 250 connected to the male terminal 200 are electrically connected through a graphene film 130.

Figure 2:
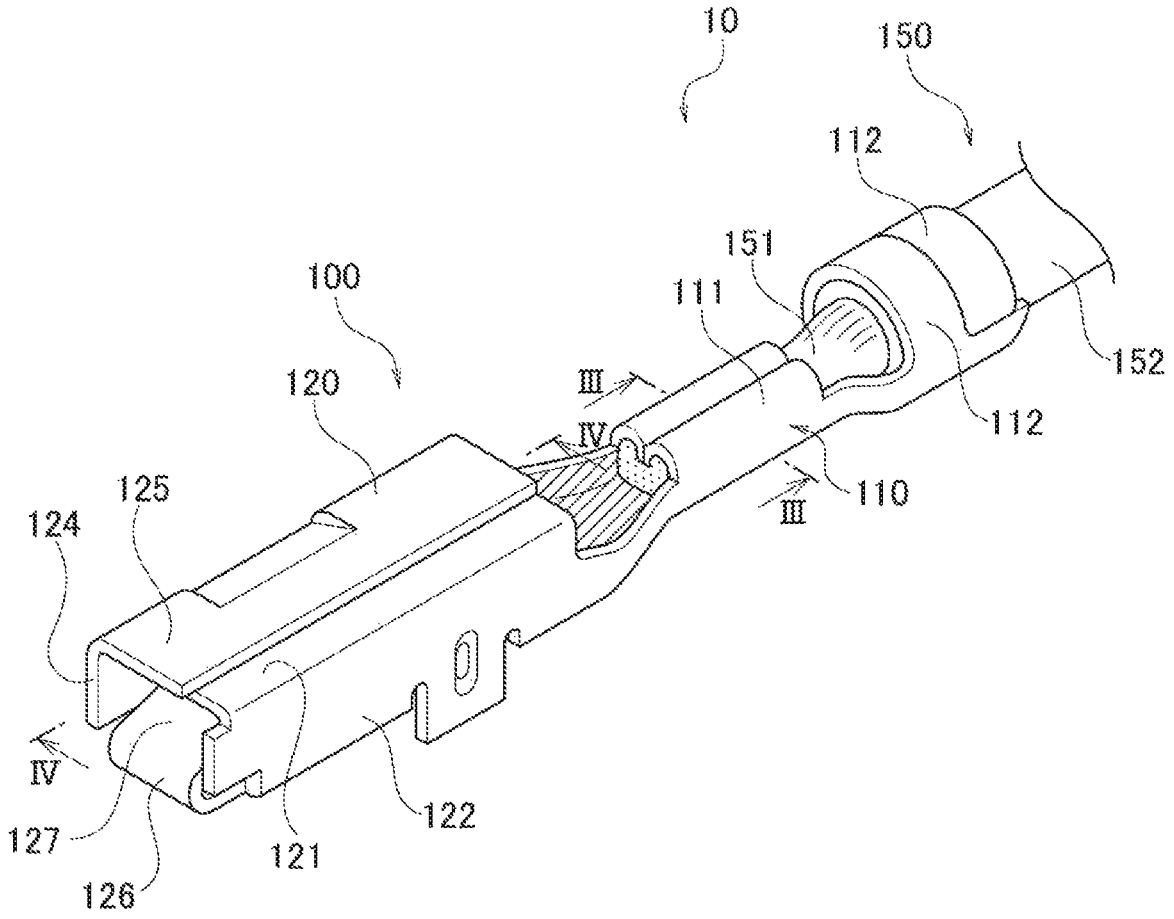
FIG. 2 is a perspective view of an example of an electric wire with terminal in which an electric wire is crimped to the female terminal shown in FIG. 1.
Figure 3:
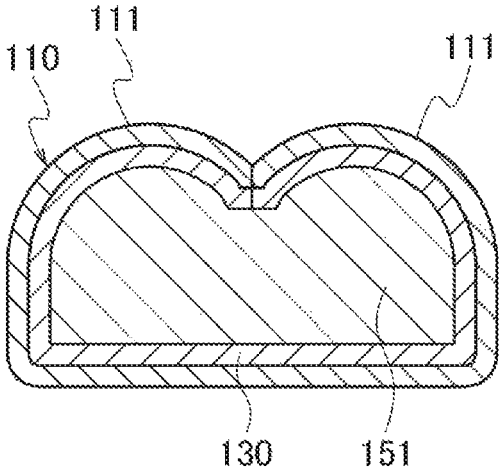
FIG. 3 is a sectional view taken along line in FIG. 2.
Figure 4:
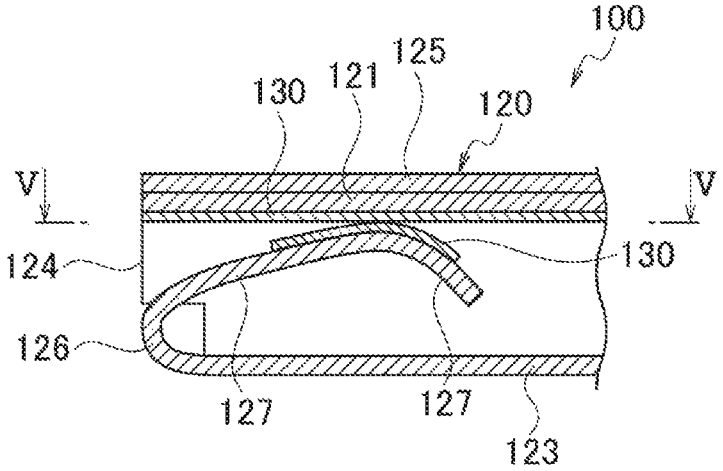
FIG. 4 is a sectional view taken along line IV-IV in FIG. 2.
Figure 5:
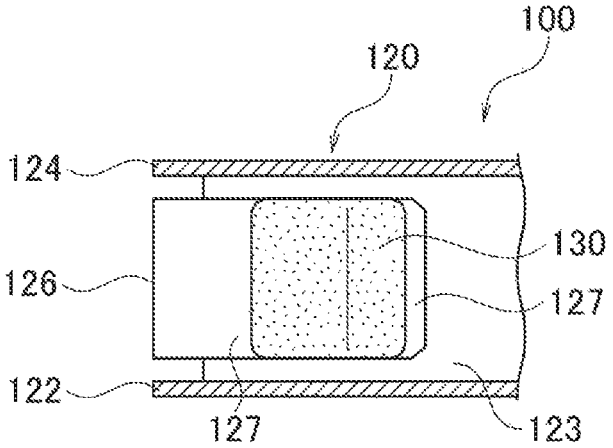
FIG. 5 is a sectional view taken along line V-V in FIG. 4.

FIG. 2 is a perspective view of an example of a female electric wire with terminal 10 in which the electric wire 150 is crimped to the female terminal 100 shown in FIG. 1. FIG. 3 is a sectional view taken along line in FIG. 2. FIG. 4 is a sectional view taken along line IV-IV in FIG. 2. FIG. 5 is a sectional view taken along line V-V in FIG. 4. As shown in FIGS. 2 to 5, the female electric wire with terminal 10 includes the female terminal 100 and the electric wire 150. The female terminal 100 includes a conductor connecting part 110, the terminal connecting part 120, and the graphene film 130. The conductor connecting part 110 is connected to the terminal connecting part 120. The conductor connecting part 110 is provided at one end of the female terminal 100, and the terminal connecting part 120 is provided at the other end of the female terminal 100.

The conductor connecting part 110 is provided to be electrically connected to a conductor 151 of the electric wire 150. The conductor connecting part 110 is provided to crimp the electric wire 150. The conductor connecting part 110 includes a conductor crimping part 111 for crimping the conductor 151 of the electric wire 150, and a covering material crimping part 112 for crimping a covering material 152 of the electric wire 150. In the female electric wire with terminal 10, the conductor connecting part 110 crimps and fixes the electric wire 150 to be connected to the female terminal 100.

The terminal connecting part 120 is provided to be electrically connected to the male terminal 200 (opposite terminal). Specifically, the terminal connecting part 120 is provided to be electrically connected to the terminal connecting part 220 of the male terminal 200.

As shown in FIGS. 2 to 5, the terminal connecting part 120 includes a box body into which the terminal connecting part 220 of the male terminal 200 is inserted, and a plate-like body that extends from a part of the box body into the box body to press the terminal connecting part 220 of the male terminal 200 inserted into the box body with elastic force.

The box body of the terminal connecting part 120 of the female terminal 100 includes a first wall part 121, a second wall part 122, a third wall part 123, a fourth wall part 124, and a fifth wall part 125, and the fifth wall part 125 overlaps the outside of the first wall part 121, forming a box-shaped body. These wall parts are bent to be substantially square in a direction perpendicular to the connecting direction of the female terminal 100 and the male terminal 200. The first wall part 121 and the third wall part 123 are opposed to each other with a space substantially in parallel. The second wall part 122 and the fourth wall part 124 are opposed to each other with a space substantially in parallel.

The plate-like body of the terminal connecting part 120 of the female terminal 100 has an elastic part 126 provided continuously and strongly bent at an end in the longitudinal direction of the third wall part 123, and a sliding part 127 provided continuously and weakly bent at the end of the elastic part 126. That is, the elastic part 126 is provided to have an inner angle smaller than that of the sliding part 127.

The elastic part 126 is formed of the same material as that of other parts constituting the terminal connecting part 120, such as the third wall part 123, but is provided with a strong elastic force due to its bent shape. The sliding part 127 is formed of the same material as that of other parts constituting the terminal connecting part 120, such as the third wall part 123, but is provided with a weak elastic force due to its bent shape. When the female terminal 100 is engaged with the male terminal 200, the terminal connecting part 220 of the male terminal 200 is supported on both sides within the terminal connecting part 120 of the female terminal 100 by the strong elastic force of the elastic part 126 and the weak elastic force of the sliding part 127.

At least a part of the conductor connecting part 110 that is a first surface is formed of a first metal material. Since the first metal material is conductive, when the conductor connecting part 110 is mechanically connected to the conductor 151 of the electric wire 150, the conductor connecting part 110 is electrically connected to the conductor 151 of the electric wire 150 through the first metal material. At least a part of the terminal connecting part 120 that is a second surface is formed of a second metal material. Since the second metal material is conductive, when the terminal connecting part 120 is mechanically connected to the male terminal 200, the terminal connecting part 120 is electrically connected to the male terminal 200 through the second metal material. The first surface may be made of the same material as that of the second surface and continuously formed with the second surface in one body.

The female terminal 100 may include a substrate. The substrate is preferably formed of copper, aluminum, iron, magnesium, an alloy containing one of these metals, or the like, which is conductive. On the surface of the substrate, a covering layer may or may not be provided. The covering layer is, for example, a plating layer. The material for forming the covering layer is not limited but preferably gold, silver, copper, tin, nickel, cobalt, or an alloy containing one of these metals. The covering layer may be a single layer or multiple layers. The thickness of the covering layer is not limited but is, for example, 0.01 to 10 μm.

At least one of the first surface and the second surface is included in the substrate or the covering layer. That is, the first metal material may be copper, aluminum, iron, magnesium or an alloy containing one of theses metals, or may be gold, silver, copper, tin, nickel, cobalt, or an alloy containing one of these metals. The second metal material may be copper, aluminum, iron, magnesium, or an alloy containing one of these metals, or may be gold, silver, copper, tin, nickel, cobalt, or an alloy containing one of these metals. The first metal material and the second metal material may be the same metal material or may be different kind of metal materials.

When the first metal material and a third metal material forming the conductor 151 of the electric wire 150 are different, different kind of metal members come into contact with each other when the conductor 151 of the electric wire 150 is electrically connected to the conductor connecting part 110. Similarly, when the second metal material and a fourth metal material forming the surface of the male terminal 200 are different, different kind of metal members come into contact with each other when the male terminal 200 is electrically connected to the terminal connecting part 120. When each metal material has a different ionization tendency, moisture adhesion to the contact part of different kind of metal members may oxidize a metal member having a high ionization tendency to cause galvanic corrosion. That is, galvanic corrosion may occur when there is at least one difference in ionization tendencies between the first metal material and the third metal material, and between the second metal material and the fourth metal material.

Then, the female terminal 100 according to the present embodiment includes the graphene film 130. The graphene film 130 is provided on at least one of the outer surface of the first surface and the outer surface of the second surface. The graphene film 130 may be provided on either the outer surface of the first surface or the outer surface of the second surface. The graphene film 130 may be provided on both the outer surface of the first surface and the outer surface of the second surface. The graphene film 130 may be provided on the entire surface of the female terminal 100.

Graphene has a planar hexagonal lattice structure formed by $sp^2$ bonds between carbon atoms. The graphene film 130 thus prevents permeation of oxygen and water causing corrosion.

When the first metal material and the third metal material forming the conductor 151 of the electric wire 150 have different ionization tendencies, the graphene film 130 is provided as follows. That is, the graphene film 130 is provided to be arranged between the first surface and the conductor 151 of the electric wire 150 when the conductor 151 of the electric wire 150 is electrically connected to the conductor connecting part 110. The graphene film 130 may be arranged only between the first surface and the conductor 151 of the electric wire 150 when the conductor 151 of the electric wire 150 is electrically connected to the conductor connecting part 110.

Since the female terminal 100 is provided with the graphene film 130, the conductor connecting part 110 and the conductor 151 of the electric wire 150 are electrically connected through the graphene film 130. Thus, the first surface and the conductor 151 of the electric wire 150 are not in direct physical contact with each other, and the different kind of metal members are not in direct physical contact with each other. Accordingly, even when moisture adheres to the contact part of the conductor connecting part 110 and the conductor 151 of the electric wire 150, galvanic corrosion between these metals is prevented.

As described above, in the present embodiment, the female terminal 100 is provided with the above-described graphene film 130 to prevent galvanic corrosion. Accordingy, it is not necessary to provide the female terminal 100 with a resin arranged across the female terminal 100 and the conductor 151 of the electric wire 150 for covering them to prevent the supply of moisture causing galvanic corrosion. It is also less necessary to form the conductor connecting part 110 in a special shape to prevent moisture adhesion due to dew condensation or the like. Thus, increase in manufacturing costs of the female terminal 100 is prevented, the degree of freedom in designing the female terminal 100 is improved, and the miniaturization of the female terminal 100 is facilitated.

The third metal material may be copper, aluminum, or an alloy of one of these metals. The first metal material may be copper, and the third metal material may be aluminum. The first metal material may be stainless steel, and the third metal material may be copper. The first metal material may be aluminum, and the third metal material may be copper. However, the present disclosure is not limited to the above-described combinations of the metal materials as long as the first metal material and the third metal material have different ionization tendencies.

In contrast, when the second metal material and the fourth metal material forming the surface of the male terminal 200 have different ionization tendencies, the graphene film 130 is provided as follows. That is, the graphene film 130 is provided to be arranged between the second surface and the surface of the male terminal 200 when the male terminal 200 is electrically connected to the terminal connecting part 120. The graphene film 130 may be arranged only between the second surface and the surface of the male terminal 200 when the male terminal 200 is electrically connected to the terminal connecting part 120.

Since the female terminal 100 is provided with the graphene film 130, the terminal connecting part 120 and the male terminal 200 are electrically connected through the graphene film 130. Thus, the second surface and the surface of the male terminal 200 are not in direct physical contact with each other, and the different kind of metal members are not in direct physical contact with each other. Accordingly, even when moisture adheres to the contact part of the terminal connecting part 120 and the male terminal 200, galvanic corrosion between these metals is prevented.

Even when the female terminal 100 and the male terminal 200 have different kinds of plating applied thereto, the provision of the graphene film 130 only to the female terminal 100 prevents galvanic corrosion when the female terminal 100 and the male terminal 200 are connected to each other. That is, galvanic corrosion is prevented by providing the graphene film 300 only to the female terminal 100 without changing the material or plating treatment method of the male terminal 200 installed in the existing apparatus. As a result, without changing the member on the existing apparatus side, the existing apparatus is used only by connecting the female terminal 100.

The fourth metal material is a material forming the surface of the male terminal 200. The male terminal 200 may be formed of the same material as the female terminal 100. Thus, the male terminal 200 may include a substrate in the same manner as the female terminal 100. The substrate of the male terminal 200 may be the same material as that of the female terminal 100. On the surface of the substrate of the male terminal 200, a covering layer similar to that of the female terminal 100 may or may not be provided. The surface of the male terminal 200 may be included in the substrate or in the covering layer. That is, the fourth metal material may be copper, aluminum, iron, magnesium, or an alloy containing one of these metals, or may be gold, silver, copper, tin, nickel, cobalt, or an alloy containing one of these metals.

The graphene film 130 may be graphene or a laminate of graphene. When considering the number of layers of graphene contained in the graphene film 130, it is preferable that grain boundaries of graphene are not connected from the surface to the metal surface to prevent the intrusion of oxygen or water and the movement of metal atoms by ionic migration. Accordingly, the number of layers of graphene to be arranged is preferably three or more.

The thickness of the graphene film 130 is preferably 0.9 nm to 10 μm from the viewpoint of contact reliability. The thickness of the graphene film 130 is obtained by observing the cross section of the graphene film 130 by a scanning electron microscope (SEM) or a transmission electron microscope (TEM) and measuring the thickness.

As described above, in the described example, the terminal is the female terminal 100 having the conductor connecting part 110, the terminal connecting part 120, and the graphene film 130, and the opposite terminal is the male terminal 200. However, the terminal according to the present embodiment is not limited to the above embodiment. The same effect is obtained, for example, when the terminal is the male terminal 200 having a conductor connecting part 210, a terminal connecting part 220, and a graphene film 230, and the opposite terminal is the female terminal 100.

Figure 6:
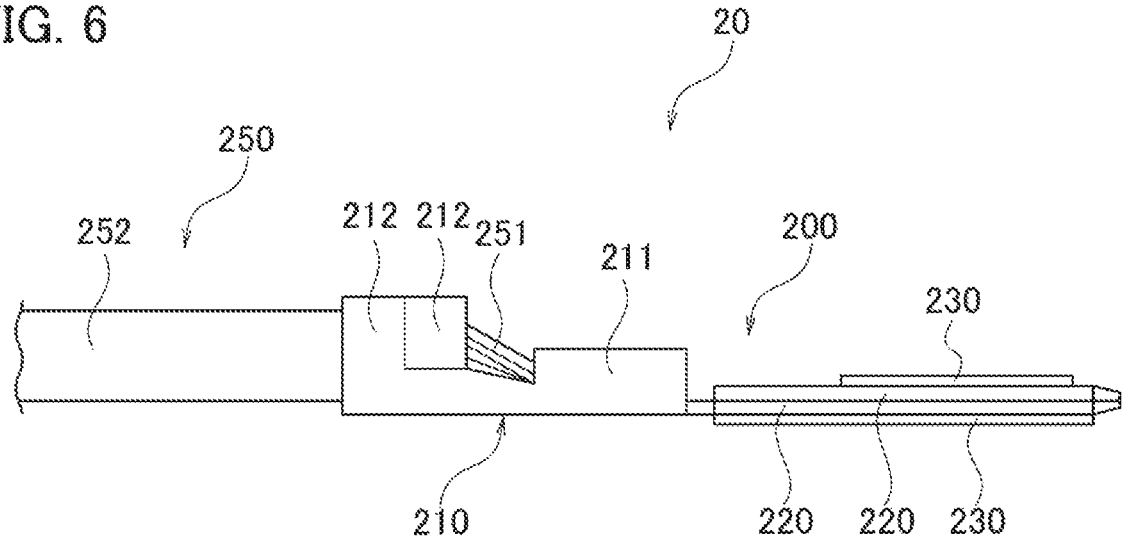
FIG. 6 is a front view of an example of an electric wire with terminal in which an electric wire is crimped to the male terminal.
Figure 7:
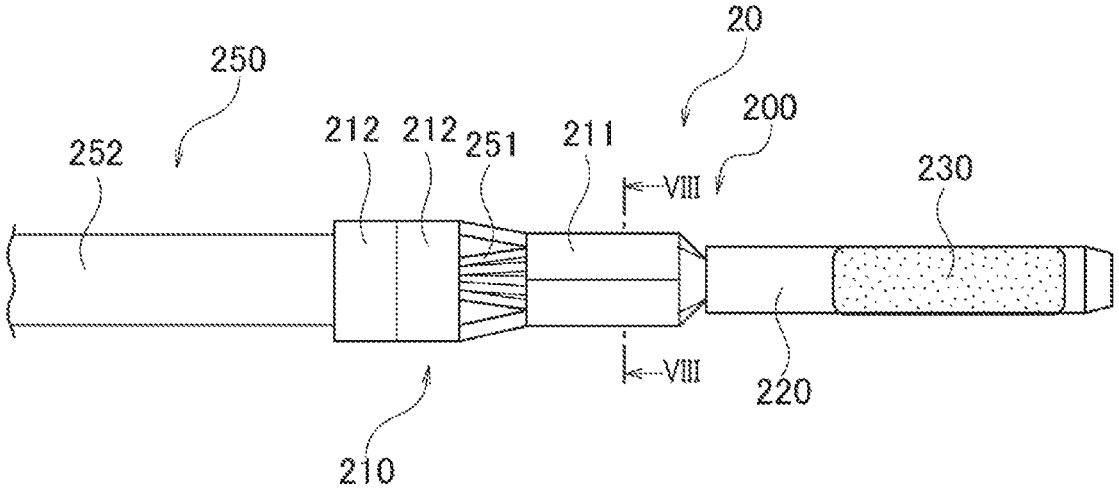
FIG. 7 is a plan view of the electric wire with terminal shown in FIG. 6.
Figure 8:
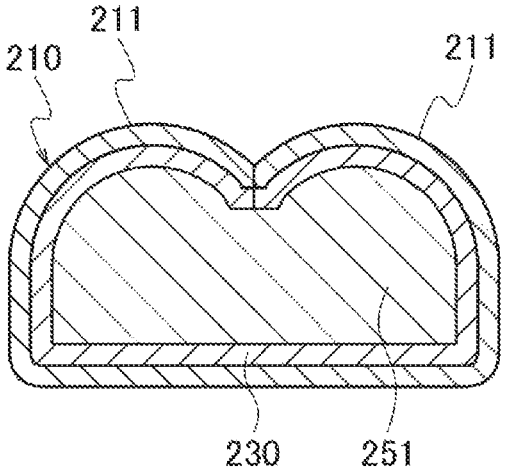
FIG. 8 is a sectional view taken along line VIII-VIII in FIG. 7.

FIG. 6 is a front view of an example of an electric wire with terminal 20 in which the electric wire 250 is crimped to the male terminal 200. FIG. 7 is a plan view of the electric wire with terminal 20 shown in FIG. 6. FIG. 8 is a sectional view taken along line VIII-VIII in FIG. 7. As shown in FIGS. 6 to 8, the male terminal 200 includes the conductor connecting part 210, the terminal connecting part 220, and the graphene film 230. The conductor connecting part 210 is connected to the terminal connecting part 220. The conductor connecting part 210 is provided at one end of the male terminal 200, and the terminal connecting part 220 is provided at the other end of the male terminal 200.

The conductor connecting part 210 is provided to be electrically connected to a conductor 251 of the electric wire 250. The conductor connecting part 110 of the female terminal 100 and the conductor connecting part 210 of the male terminal 200 may have the same shape. The conductor connecting part 210 is provided to crimp the electric wire 250. The conductor connecting part 210 includes a conductor crimping part 211 for crimping the conductor 251 of the electric wire 250, and a covering material crimping part 212 for crimping a covering material 252 of the electric wire 250. In the male electric wire with terminal 20, the conductor connecting part 210 crimps and fixes the electric wire 250 to be connected to the male terminal 200.

The terminal connecting part 220 is provided to be electrically connected to the female terminal 100. Specifically, the terminal connecting part 220 is provided to be electrically connected to the terminal connecting part 120 of the female terminal 100.

At least a part of the conductor connecting part 210 that is a first surface is formed of a first metal material. At least a part of the terminal connecting part 220 that is a second surface is formed of a second metal material. The male terminal 200 may be formed of the same material as that of the female terminal 100. When the terminal is the male terminal 200 and the opposite terminal is the female terminal 100, the same material as the above-mentioned fourth metal material may be used for the first metal material. Further, when the terminal is the male terminal 200 and the opposite terminal is the female terminal 100, the same material as the above-mentioned fourth metal material may be used for the second metal material.

The graphene film 230 is provided on at least one of the outer surface of the first surface and the outer surface of the second surface. The graphene film 230 may be made of the same material as that of the graphene film 130.

When the first metal material and the third metal material forming the conductor 251 of the electric wire 250 have different ionization tendencies, the graphene film 230 is provided as follows. That is, the graphene film 230 is provided to be arranged between the first surface and the conductor 251 of the electric wire 250 when the conductor 251 of the electric wire 250 is electrically connected to the conductor connecting part 210.

In contrast, when the second metal material and the fourth metal material forming the surface of the female terminal 100 have different ionization tendencies, the graphene film 230 is provided as follows. That is, the graphene film 230 is provided to be arranged between the second surface and the surface of the female terminal 100 when the female terminal 100 is electrically connected to the terminal connecting part 220.

Thus, when the terminal is the male terminal 200 and the opposite terminal is the female terminal 100, the graphene film 230 prevents galvanic corrosion between different kind of metals.

As described above, a terminal according to the present embodiment includes a conductor connecting part provided to be electrically connected to a conductor of an electric wire, a terminal connecting part provided to be electrically connected to an opposite terminal, and a graphene film. A first surface that is at least a part of the conductor connecting part is formed of a first metal material, and a second surface that is at least a part of the terminal connecting part is formed of a second metal material. The graphene film is provided on at least one of an outer surface of the first surface and an outer surface of the second surface. When the first metal material and a third metal material forming the conductor of the electric wire have different ionization tendencies, the graphene film is provided to be arranged between the first surface and the conductor of the electric wire when the conductor of the electric wire is electrically connected to the conductor connecting part. When the second metal material and a fourth metal material forming the surface of the opposite terminal have different ionization tendencies, the graphene film is provided to be arranged between the second surface and the surface of the opposite terminal when the opposite terminal is electrically connected to the terminal connecting part. Therefore, the terminal according to the present embodiment prevents galvanic corrosion at the contact part of different kind of metals.

[Electric Wire with Terminal]

The electric wire with terminal 10 according to the present embodiment includes the female terminal 100 and the electric wire 150 connected to the female terminal 100. The conductor 151 of the electric wire 150 is electrically connected to the conductor connecting part 110. As described above, the female terminal 100 includes the above graphene film 130, and galvanic corrosion between different kind of metals is prevented. Therefore, in the electric wire with terminal 10 including the female terminal 100 and the electric wire 150, galvanic corrosion is also prevented in the same way.

The electric wire 150 includes the conductor 151 and the covering material 152 covering the conductor 151.

The conductor 151 may include element wires. The conductor 151 may be a single wire, or a stranded wire formed by twisting multiple element wires (3 to 1500 wires, for example, 7 wires), which are single wires. The conductor 151 is generally a stranded wire. Here, the electric wire is a covered wire formed by covering a stranded wire as a bare wire with any insulating resin layer. A wire harness is formed by bundling these electric wires into one and wrapping by sheathing.

As the material of the conductor 151, a metal having high conductivity may be used. The conductor 151 is made of, for example, copper, aluminum, an alloy of one of these metals, or the like. Weight reduction has been demanded for the electric wire 150. Thus, the conductor 151 is preferably made of aluminum or an aluminum alloy, which is lightweight.

As the material of the covering material 152 for covering the conductor 151, a resin ensuring electrical insulation may be used. The covering material 152 is made of an olefin-based resin, for example. Specifically, as the material of the covering material 152, at least one resin selected from the group consisting of polyethylene (PE), polypropylene (PP), ethylene copolymers, and propylene copolymers may be used as a main component. As the material of the covering material 152, polyvinyl chloride (PVC) may be used as a main component. Among these materials, the material of the covering material 152 preferably contains polypropylene or polyvinyl chloride as a main component because of its high flexibility and durability. Here, the main component means a component of 50% by mass or more of the whole covering material 152.

Although in the described example, the electric wire with terminal 10 includes the female terminal 100, the male terminal 200 also prevents galvanic corrosion in the same manner as the female terminal 100 as described above. Accordingly, the electric wire with terminal 20 may include the male terminal 200 and the electric wire 250 connected to the male terminal 200. The conductor 251 of the electric wire 250 may be electrically connected to the conductor connecting part 210. Even in such an electric wire with terminal 20, galvanic corrosion is prevented in the same manner as described above. The electric wire 250 may be the same as the electric wire 150 described above.

As described above, the electric wire with terminal includes the terminal and the electric wire connected to the terminal, and the conductor of the electric wire is electrically connected to the conductor connecting part. Thus, the electric wire with terminal according to the present embodiment prevents galvanic corrosion at the contact part of different kind of metals.

No resin may be arranged across the terminal and the conductor of the electric wire for covering the terminal and the conductor. It is thus less necessary to form the conductor connecting part in a special shape to prevent moisture adhesion due to dew condensation or the like. Thus, increase in manufacturing costs of the terminal is prevented, the degree of freedom in designing the terminal is improved, and miniaturization of the terminal is facilitated.

[Electric Connection Member]

The electric connection member according to the present embodiment includes the female terminal 100 and the male terminal 200, and the female terminal 100 and the male terminal 200 are connected to each other. As described above, the female terminal 100 prevents galvanic corrosion at the contact part of different kind of metals. Thus, even when the female terminal 100 and the male terminal 200 are connected to each other, galvanic corrosion is prevented. Note that the same effect is obtained even when either the female terminal 100 or the male terminal 200 is provided with the graphene film 130, or both the female terminal 100 and the male terminal 200 are provided with the graphene film 130. Accordingly, at least one of the female terminal 100 and the male terminal 200 is provided with the graphene film 130 as described above. That is, the electric connection member includes a terminal and an opposite terminal, and the terminal and the opposite terminal are connected to each other.

[Terminal Manufacturing Method]

Next, with reference to FIGS. 9 to 12, a method of manufacturing the female terminal 100 shown in FIG. 2 is described. The manufacturing method of the female terminal 100 includes a step of forming a terminal connecting part, a step of forming a conductor connecting part, and a step of forming a graphene film.

(Formation of Terminal Connecting Part)

Figure 9:
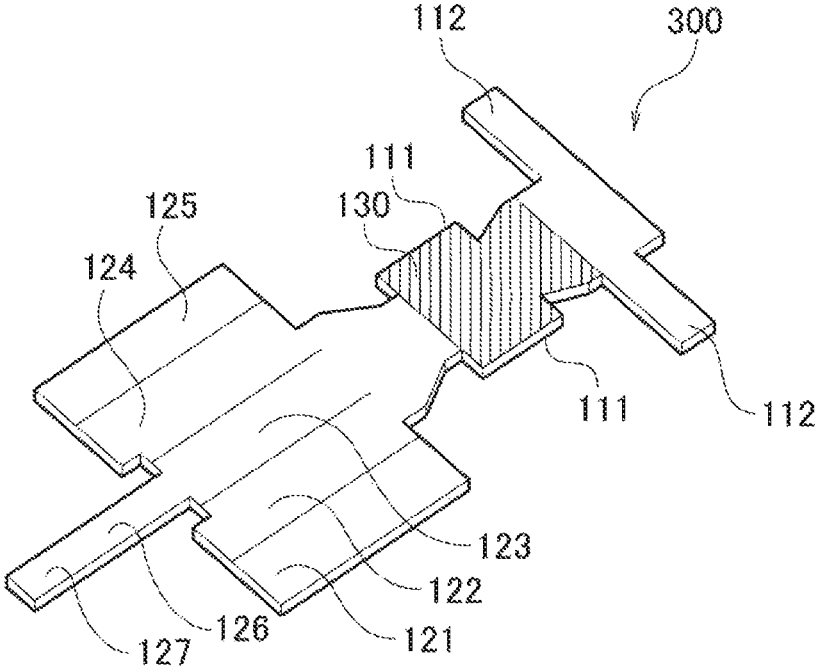
FIG. 9 is a perspective view of a plate-like member forming the female terminal.

First, a method of forming the terminal connecting part 120 is described. FIG. 9 is a perspective view of a plate-like member 300 forming the female terminal 100. The box-shaped body of the terminal connecting part 120 of the female terminal 100 is formed by bending the first wall part 121, the second wall part 122, the third wall part 123, the fourth wall part 124, and the fifth wall part 125 shown in FIG. 9 inward along four straight lines drawn between these members. The box-shaped body of the terminal connecting part 120 of the female terminal 100 is given a strength for maintaining the box-shaped shape by bending the fifth wall part 125 to overlap the outside of the first wall part 121, thus having increased fitting strength with the terminal connecting part 220 of the male terminal 200. In the present embodiment, one sheet of the plate-like member 300 is bent so that the conductor connecting part 110 and the terminal connecting part 120 are continuously formed in one body, but the conductor connecting part 110 and the terminal connecting part 120 may be formed by combining different members.

The plate-like member 300 may include a substrate. The substrate may be formed of a metal. The material forming the substrate is preferably copper, aluminum, iron, magnesium, or an alloy containing one of these metals. The plate-like member 300 may include a substrate and a covering layer covering the surface of the substrate. The covering layer is, for example, a plating layer. The material forming the covering layer is not limited but is preferably gold, silver, copper, tin, nickel, cobalt, or an alloy containing one of these metals. The covering layer is a single layer or a plurality of layers. The thickness of the covering layer is not limited but is, for example, 0.01 to 10 μm. The covering layer is formed on the surface of the substrate before or after the bending process.

(Formation of Conductor Connecting Part)

Figure 10:
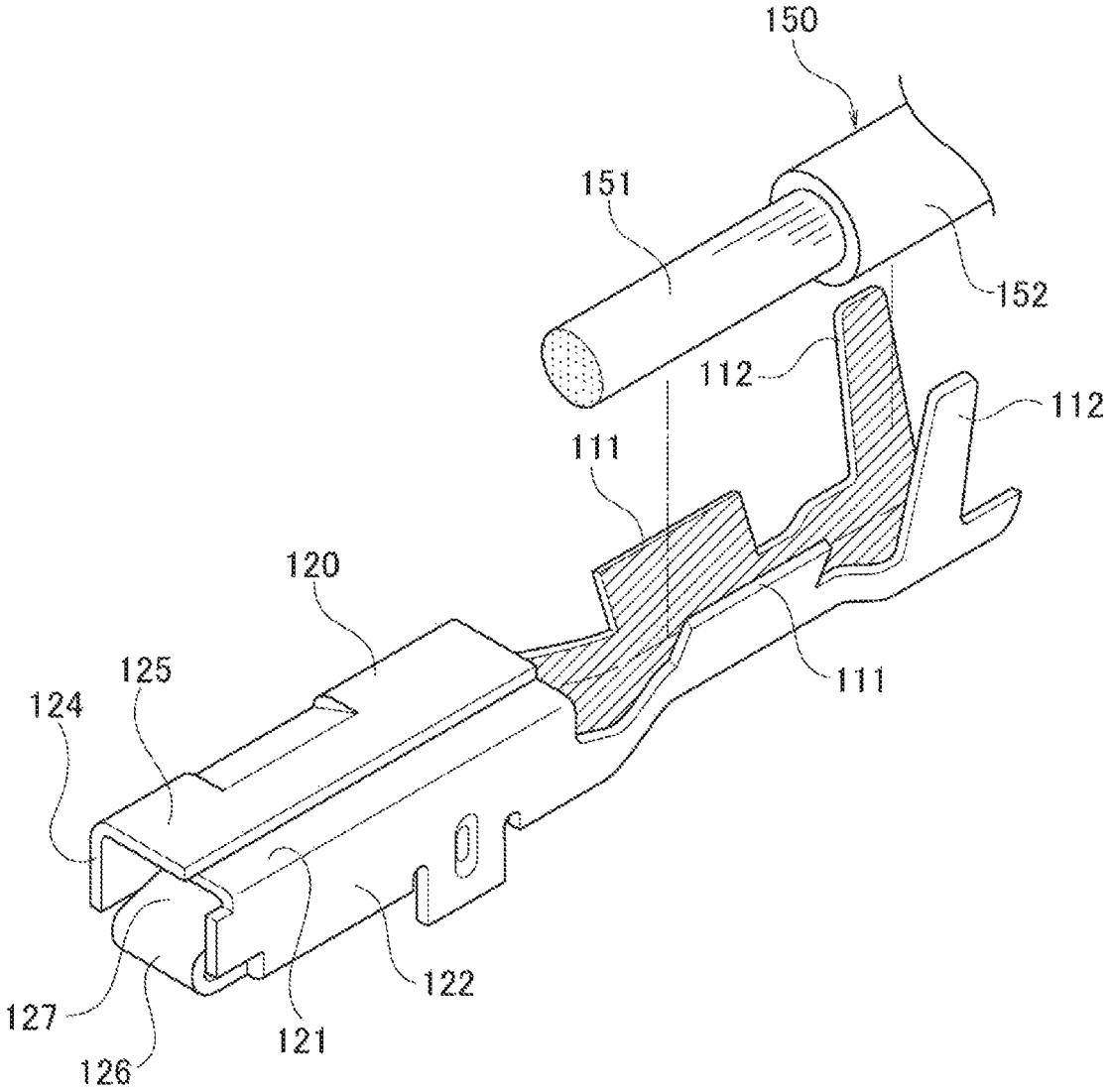
FIG. 10 is a perspective view illustrating a state before the electric wire is crimped to the female terminal

Next, a method of crimping the electric wire 150 to the conductor connecting part 110 of the female terminal 100 is described. FIG. 10 is a perspective view showing a state before the electric wire 150 is crimped to the female terminal 100. First, the conductor 151 of the electric wire 150 is arranged on the upper surface of the conductor crimping part 111 before crimping and is wrapped and crimped by the conductor crimping part 111. Similarly, the electric wire 150 including the covering material 152 is arranged on the upper surface of the covering material crimping part 112 before crimping and is wrapped and crimped by the covering material crimping part 112. By crimping the electric wire 150 to the conductor connecting part 110 in this manner, the electric wire 150 is electrically and mechanically connected to the conductor connecting part 110, and the electric wire with terminal 10 as shown in FIG. 2 is formed. Although the method of connecting the electric wire 150 to the conductor connecting part 110 of the female terminal 100 has been described, the same is true for the method of connecting the electric wire 250 to the conductor connecting part 210 of the male terminal 200.

(Formation of Graphene Film)

Next, a method of forming the graphene film 130 on the female terminal 100 is described. The method of forming the graphene film 130 on the female terminal 100 is not limited, and for example, the graphene film 130 may be formed on the female terminal 100 by a known method, such as a CVD (chemical vapor deposition) method. However, from the viewpoint of preventing a decrease in the crimping strength of the conductor connecting part 110 due to heating and a decrease in the elastic force of the elastic part 126 due to heating, it is preferable to form the graphene film 130 on the female terminal 100 by transfer by the stamp member or heating with a laser beam.

Figure 11:
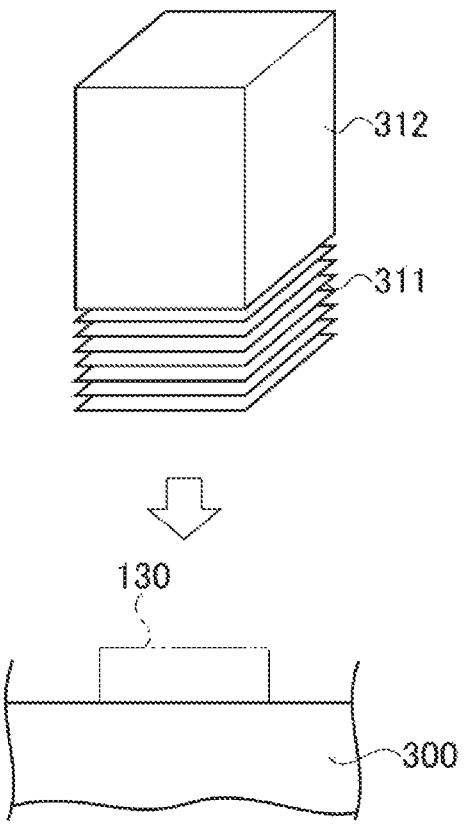
FIG. 11 is a diagram illustrating an example of forming a graphene film on a plate-like member by transfer with a stamp member.

First, a method of forming the graphene film 130 on the female terminal 100 by transfer by the stamp member is described. FIG. 11 shows an example in which a pressing graphene member 311 is transferred onto the surface of the plate-like member 300 to form the graphene film 130. The pressing graphene member 311 is transferred to the plate-like member 300 by using a stamp member 312.

The pressing graphene member 311 is graphene or a laminate of graphene similar to the graphene film 130 described above. The pressing graphene member 311 is arranged on the surface of the stamp member 312. The pressing graphene member 311 has a surface having the same shape and size as those of the surface of the stamp member 312.

The stamp member 312 has adhesiveness at least on a surface in contact with the pressing graphene member 311. The stamp member 312 holds the pressing graphene member 311 by the adhesiveness. The adhesiveness means the adhesive property to the pressing graphene member 311. The material forming the stamp member 312 is, for example, silicone resin, or elastomer uniformly applied with an adhesive, or the like.

As shown in FIG. 11, when the pressing graphene member 311 arranged on the surface of the stamp member 312 is relatively moved together with the stamp member 312 in a direction toward the plate-shaped member 300, the pressing graphene member 311 is sandwiched between the plate-shaped member 300 and the stamp member 312. Thus, the pressing graphene member 311 is pressed to the plate-like member 300. After the pressing graphene member 311 is pressed, when the stamp member 312 is moved in a direction away from the plate-like member 300, graphene of at least one layer or more of the pressing graphene member 311 is transferred to the surface of the plate-like member 300. Thus, at least a part of the surface of the plate-like member 300 is formed with the graphene film 130. According to this method, because heating treatment is not performed, when the graphene film 130 is formed, it is possible to prevent a decrease in the crimping strength of the conductor connecting part 110 due to heating and a decrease in the elastic force of the elastic part 126 due to heating.

Figure 12:
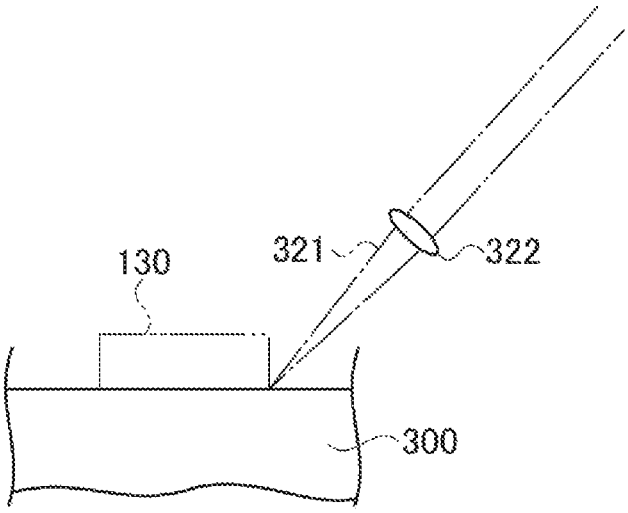
FIG. 12 is a diagram illustrating an example of forming a graphene film on a plate-like member by heating with laser beam.

Next, a method of forming the graphene film 130 on the plate-like member 300 by heating with a laser beam is described. FIG. 12 is a top view illustrating the formation of the graphene film 130 by irradiating the region of the plate-like member 300 where the conductor connecting part 110 is to be formed with the laser beam 321. The laser beam 321 is condensed by the condenser lens 322, and the region where the conductor connecting part 110 is formed is irradiated and heated. The region irradiated with the laser beam 321 is at least a part of the plate-like member 300 and may be only a region where the conductor connecting part 110 is formed or may be the entire surface of the plate-like member 300.

The graphene film 130 is formed by irradiation and heating with the laser beam 321. The laser beam 321 has a characteristic of easily condensing energy and can irradiate and heat a local position with the laser beam 321. Thus, it is not necessary to heat the entire terminal as in the conventional CVD method. When the plate-like member 300 includes a part adversely affected by heating, the graphene film 130 may be formed excluding that part.

The graphene film 130 is formed by irradiating and heating a raw material of the graphene film 130 with the laser beam 321. The temperature of the region heated by the laser beam 321 is, for example, 300 to 400° C. in view of reaction efficiency and reaction time of graphene. The raw material of the graphene film 130 is not limited as long as the graphene film 130 having graphene can be formed by heating with the laser beam 321. Examples of the raw material of the graphene film 130 include gaseous raw materials, liquid raw materials, and solid raw materials.

When the raw material of the graphene film 130 is a gas, it is preferable that the conductor connecting part is irradiated and heated with the laser beam 321 under the atmosphere of the gas raw material to form the graphene film 130. The gaseous raw material of the graphene film 130 is preferably a carbon-containing gas such as methane gas, ethylene gas, acetylene gas, ethanol gas, acetone gas, methanol gas, or a combination of these gases.

When the raw material of the graphene film 130 is a liquid or a solid, for example, it is preferable that a liquid raw material or a solid raw material is arranged on the surface of the plate-like member 300, and the raw material is irradiated and heated with the laser beam 321 so that the graphene film 130 is formed.

The liquid or solid raw material of the graphene film 130 is preferably an organic material, such as polymethyl methacrylate (PMMA), graphene oxide (GO), or the like. When the raw material of the graphene film 130 is graphene oxide, the graphene oxide is irradiated and heated with the laser beam 321 to be reduced, and the graphene film 130 containing graphene is formed.

As described above, by forming the graphene film 130 on the female terminal 100 by transfer by the stamp member or heating with the laser beam, it is possible to prevent the decrease in the crimping strength of the conductor connecting part 110 due to heating and the decrease in the elastic force of the elastic part 126 due to heating. Since the decrease in the crimping strength of the conductor connecting part 110 and the decrease in the elastic force of the elastic part 126 are prevented or reduced, increase in size of the terminal is prevented or reduced.

The method of forming the graphene film 130 on the plate-like member 300 is described in the present embodiment. However, after the plate-like member 300 is bent to form the female terminal 100, the graphene film 130 may be formed at a desired position on the female terminal 100. Further, the graphene film 130 may be formed at a desired position in an intermediate member in the middle of forming the female terminal 100 from the plate-like member 300. Although the method of forming the graphene film 130 on the female terminal 100 is described in the present embodiment, the graphene film 130 can be formed on the male terminal 200 by the same method as the female terminal 100.

The present embodiment is described above. The present embodiment is however not limited thereto, and various modifications can be made within the scope of the gist of the present embodiment.

What is claimed is:

1. A terminal, comprising:

a conductor connecting part provided to be electrically connected to a conductor of an electric wire;

a terminal connecting part having a flat shape with a tapered distal end, the terminal connecting part provided to be electrically connected to an opposite terminal; and a graphene film, wherein a first surface that is at least a part of the conductor connecting part is formed of a first metal material, a second surface that is at least a part of the terminal connecting part is formed of a second metal material, the graphene film is provided on at least one of an outer surface of the first surface and an outer surface of the second surface, when the first metal material and a third metal material forming the conductor of the electric wire have different ionization tendencies, the graphene film is provided to be arranged between the first surface and the conductor of the electric wire when the conductor of the electric wire is electrically connected to the conductor connecting part, when the second metal material and a fourth metal material forming a surface of the opposite terminal have different ionization tendencies, the graphene film is provided to be arranged between the second surface and the surface of the opposite terminal when the opposite terminal is electrically connected to the terminal connecting part the terminal is formed of a plate member, and the graphene film is provided on only a part of a surface of the plate member, wherein the part of the surface of the plate member comprises the at least one of the outer surface of the first surface and the outer surface of the second surface.

2. The terminal according to claim 1, wherein the first metal material is copper, and the third metal material is aluminum.

3. An electric wire with terminal, comprising:

the terminal according to claim 1; and the electric wire connected to the terminal, wherein the conductor of the electric wire is electrically connected to the conductor connecting part.

4. The electric wire with terminal according to claim 3, wherein no resin is arranged across the terminal and the conductor of the electric wire for covering the terminal and the conductor.

5. An electric connection member, comprising:

the terminal according to claim 1; and the opposite terminal, wherein the terminal and the opposite terminal are connected to each other.

6. The terminal according to claim 1, wherein the terminal connecting part is provided on an opposite axial end of the conductor connecting part and includes a box body having a sliding part having the flat shape with the tapered distal end.

* * * * *